United States Patent [19]

Allen et al.

[11] 4,327,891

[45] May 4, 1982

[54] FLUSH VALVE DIAPHRAGM HAVING PLASTIC INSERT

[75] Inventors: Charles S. Allen, River Forest; Charles C. Allen, Oak Brook; Frederic Lissau, Chicago, all of Ill.

[73] Assignee: Sloan Valve Company, Franklin Park, Ill.

[21] Appl. No.: 173,594

[22] Filed: Jul. 30, 1980

[51] Int. Cl.[3] ..... F16K 31/145

[52] U.S. Cl. ..... 251/38; 92/103 F; 251/40; 251/45; 251/61.1

[58] Field of Search ..... 251/38, 40, 45, 61.1, 251/46; 92/103 R, 103 F

[56] References Cited

U.S. PATENT DOCUMENTS

| | | | |
|---|---|---|---|
| 1,714,573 | 5/1929 | Sloan | 92/103 R |
| 2,046,004 | 6/1936 | Sloan | 251/40 |
| 2,776,812 | 1/1957 | Colendar | 251/40 |
| 2,916,251 | 12/1959 | Butts | 251/40 |
| 3,911,796 | 10/1975 | Hull et al. | 92/103 R |

*Primary Examiner*—George L. Walton

*Attorney, Agent, or Firm*—Kinzer, Plyer, Dorn & McEachran

[57] ABSTRACT

A diaphragm for a flush valve is made of molded rubber with a plastic insert for strengthening the diaphragm. The insert includes reinforcing means located at the points where the diaphragm is attached to the valve parts. There is also a plurality of spaced, rigid sections placed between the points of attachment. Connecting means are provided for connecting the reinforcing means and the rigid sections together. The connecting means is arranged to permit flexibility of the diaphragm in two planes. Thus, the diaphragm is permitted to flex both in the plane of the diaphragm and perpendicular to the diaphragm.

20 Claims, 5 Drawing Figures

38

84
72
82
86
80
74
84
60
5
70
72
82
84
80
70
5
4
84
86
76
4
42
3
74
64
80
62
72
3
78
60
84
86
84
68
72
68
82
74
66

FLUSH VALVE DIAPHRAGM HAVING PLASTIC INSERT

SUMMARY OF THE INVENTION

This invention relates in general to improvements in flush valves for urinals and other plumbing equipment. In particular, the invention relates to an improved diaphragm for use in flush valves.

A primary object of the present invention is a diaphragm of the type described having a plastic insert for strengthening the diaphragm.

Another object is a strengthening insert for a flush valve diaphragm which permits flexibility in two directions.

Another object is a flush valve diaphragm having a plastic insert which prevents chatter when the valve closes.

Another object is a flush valve diaphragm having a plastic strengthening insert which can be made as a single piece.

Another object is a flush valve diaphragm having a plastic insert with a by-pass formed in the insert.

Other objects will appear in the following specification, drawings and claims.

DESCRIPTION OF A PREFERRED EMBODIMENT

Figure 1:
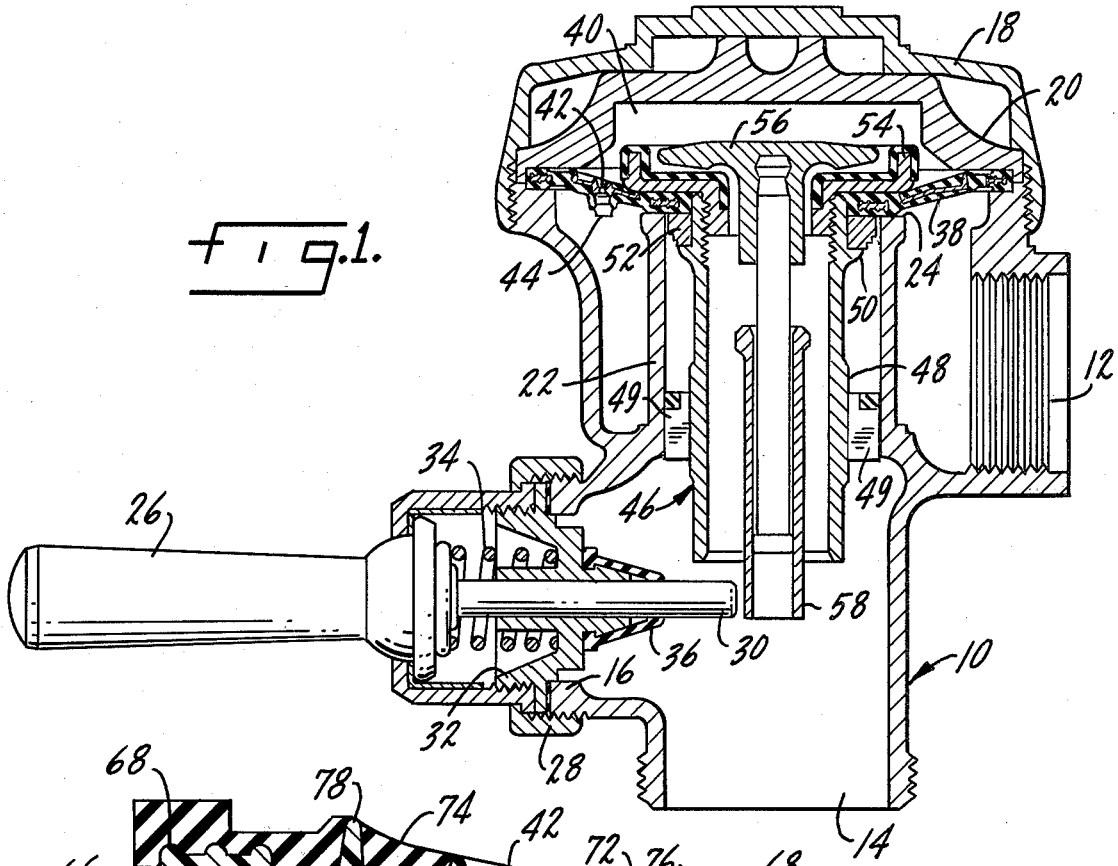
FIG. 1 is a cross-sectional elevation view of the flush valve including a diaphragm according to the present invention.

This invention relates to flush valves and in particular to an improved diaphragm for use in such valves. A flush valve of the type in which the present invention may be advantageously employed is shown in FIG. 1. The flush valve has a generally hollow body 10 which includes an inlet connection 12, an outlet connection 14 and a handle coupling connection 16. The top of the valve body is closed by an outer cover 18 and an inner cover 20. The inlet portion of the valve is separated from the outlet portion by a central throat 22 which is attached to the inside walls of the valve body 10. A main valve seat 24 is formed on the top of the throat.

The valve is actuated by an operating handle 26 which is fastened to the valve body 10 by means of coupling nut 28. The handle is connected to a plunger 30 which extends to the interior portion of the valve body. The plunger 30 is guided and supported by a bushing 32 and restored by a spring 34. A rubber sealing cap or packing 36 is snapped on the end of bushing 32 and prevents leakage outward from the handle opening.

The annular valve seat 24 is normally closed by a diaphragm 38. The diaphragm extends across the body 10 and defines an upper chamber 40. The diaphragm has a by-pass 42 which provides fluid communication between the inlet side of the valve and the upper chamber

40. A filter 44 may be provided by prevent clogging of the by-pass 42.

The diaphragm 38 is attached at its outer edge to the valve body. The outer cover 18 clamps the diaphragm between a shoulder on the valve body and the inner cover 20. The center of the diaphragm has an opening which allows fluid communication between the upper chamber 40 and the outlet 14. A relief valve shown generally at 46 is attached to the diaphragm and normally closes the opening at the center of the diaphragm. The relief valve 46 includes a guide portion 48 having wings 49. The wings fit closely against the inside diameter of the throat 22. The guide 48 also has a lip 50. The lip supports a collar 52. The relief valve includes a clamping member 54 which is threadedly engaged with the guide portion 48. The clamping member 54 clamps the inner edge of the diaphragm 38 between the member 54 and the collar 52. The clamping member 54 has a hole in the middle which is normally closed by an auxiliary valve member 56. This member is connected to a depending stem 58 which extends to a point opposite the actuating plunger 30. The clamping member 54 may have a rubber liner to improve the sealing contact between the auxiliary valve member 56 and the clamping member.

The operation of the valve is as follows. In the normally-closed position shown in FIG. 1, water pressure at the valve inlet is communicated to the upper chamber 40 through the by-pass 42. Since the surface area subjected to the water pressure is greater on the upper side of the diaphragm, the water pressure forces the diaphragm down onto the valve seat 24. This prevents water from flowing to the outlet 14. When a user rotates the handle 26 in any direction the plunger 30 moves inwardly, tilting the stem 58 and moving the auxiliary valve member 56 out of the sealing engagement with the clamping member 54. This relieves the pressure in the upper chamber 40 by allowing water to flow through the guide member 48. With the upper chamber pressure relieved the inlet water pressure forces the diaphragm upwardly, off of the main valve seat 24. Water then flows directly from the inlet, through the throat 22 and to the outlet 14. When the diaphragm 38 and relief valve 46 move upwardly the auxiliary valve member 56 reseats, closing off the upper chamber, forcing the diaphragm back onto the main valve seat 24 to close the valve. The guide 48 and its associated wings 49 contact the throat 22 to provide stability to the diaphragm as it moves. The guide keeps the diaphragm level as it closes and thus prevents chattering. Should the operating lever 26 be held overly long, the valve will still operate as the stem 58 has a telescoping part which will allow it to return to its normal position even though obstructed by the plunger 30.

It can be seen that the diaphragm 38 must be flexible in a direction perpendicular to the plane of the diaphragm. This is to permit its up and down motion. The diaphragm must also flex in a direction parallel to the plane of the diaphragm. Looking at FIG. 1, it will be seen that the portion of the diaphragm between its attachment points is angled downwardly from horizontal. In this position each side of the diaphragm may be considered to form the hypotenuse of a triangle whose other legs are horizontal and vertical. When the diaphragm moves from the hypotenuse position to the base of a triangle (as it will when the valve opens) the diaphragm is compressed and it becomes approximately 0.01 inches shorter. This is why flexibility in two directions is required.

Molded rubber is a suitable material having sufficient flexibility for the diaphragm. However, the diaphragm must also have sufficient strength to withstand the water pressure and the clamping forces at the diaphragm attachment points. Also, the diaphragm material must permit formation of the by-pass. Rubber alone does not have the desired characteristics. So in the past the diaphragm has included brass reinforcing rings at the outer edge of the diaphragm and also at the central opening. Further, individual, rigid brass inserts are placed between the reinforcing rings to provide additional stability. The inserts prevent the diaphragm from slipping sideways and thus help to eliminate valve closing chatter. This structure is shown in U.S. Pat. Nos. 1,714,573 and 2,776,812.

The present invention provides a diaphragm in which all the necessary reinforcements may be formed of plastic material as a one-piece insert. The insert is molded into the rubber portion of the diaphragm. This has the advantage that only one piece has to be aligned in the rubber mold and the parts of the insert itself are not subject to movement during the molding process.

Figure 2:
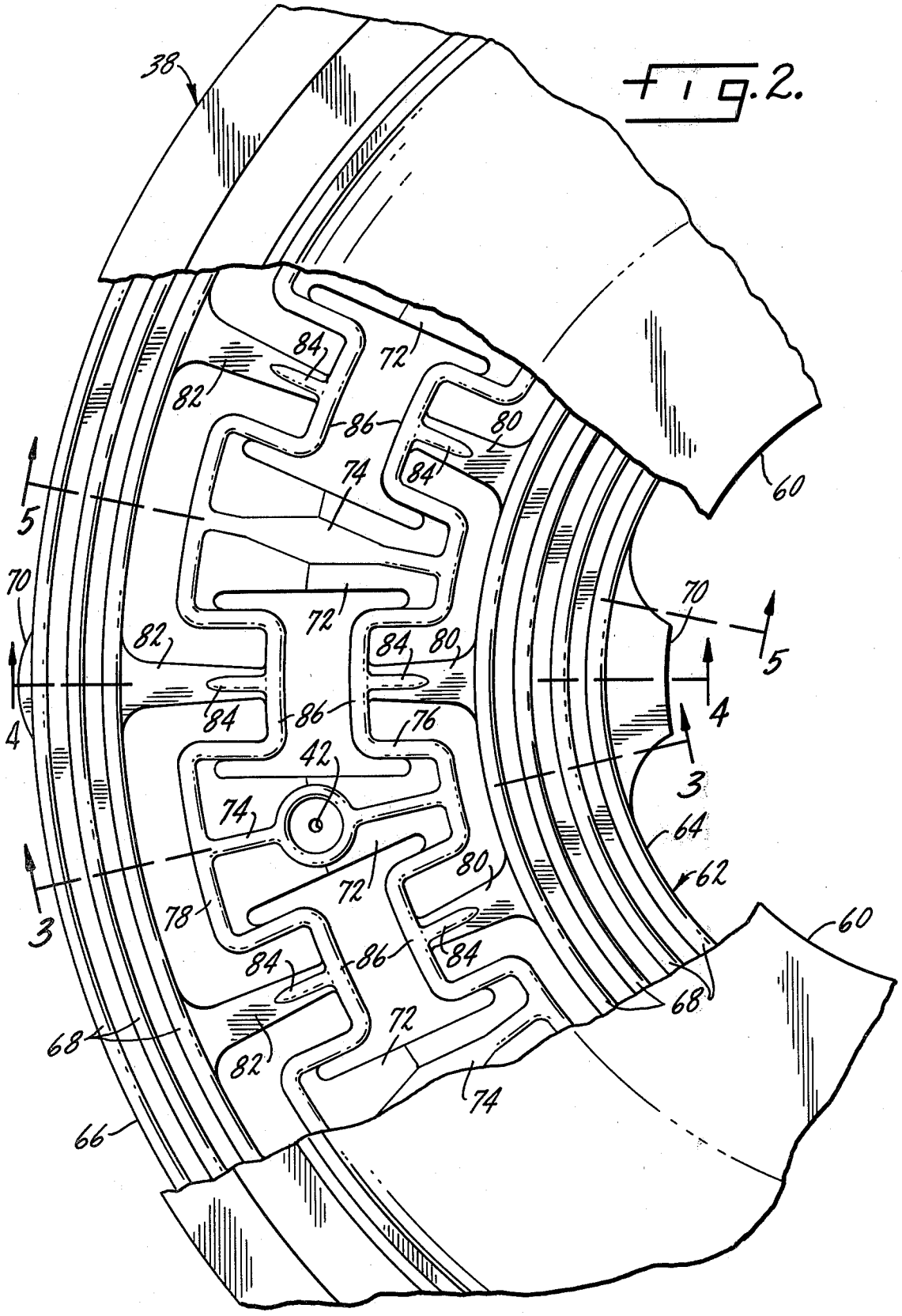
FIG. 2 is a top plan view, with portions cut away, of a segment of a flush valve diaphragm according to the present invention.

A diaphragm according to the present invention is shown in FIG. 2. The diaphragm has a molded rubber covering 60 and a plastic insert shown generally at 62. The insert has a reinforcing means at the points of attachment of the diaphragm. The reinforcing means includes an inner ring 64 and an outer ring 66. Each ring includes a series of ridges 68 which stabilize the position of the rings in the rubber. There may also be a series of locater tabs 70 which assist in positioning the insert 62 during molding.

A plurality of spaced, rigid sections 72 are located between the inner and outer reinforcing rings. The sections 72 have a center ridge 74. These rigid sections 72 are positioned so to not interfere with the flexing of the rubber portion 60 of the diaphragm.

The rigid sections 72 are held in place by connecting means in the form of a pair of continuous ribs 76 and 78. The ribs are attached to either side of the rigid sections 72. In a preferred embodiment the rib 76 has a plurality of fingers 80 connected to the rib and extending to the inner reinforcing ring 68. Similarly, the rib 78 has fingers 82 attached to the rib and to the outer reinforcing ring. Each of the fingers 80 and 82 may also include a ridge 84 to aid in strengthening the fingers. The fingers also serve as sprues during the molding of the insert.

The ribs 76 and 78 are crimped between successive rigid sections 72. The crimped portions are illustrated at 86. The crimped portions provide a winding configuration for the ribs which increases the ribs' flexibility. In a preferred embodiment the fingers 80 and 82 are attached at the crimped portions of the ribs.

Figure 3:
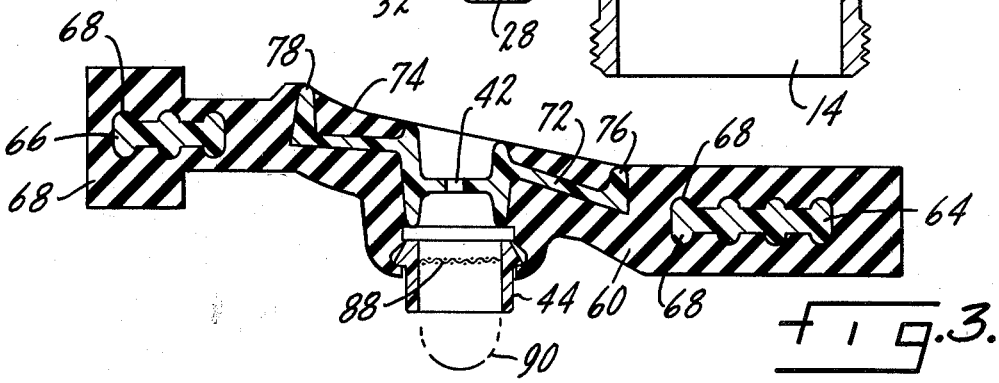
FIG. 3 is a section taken substantially along line 3—3 of FIG. 2.
Figure 4:
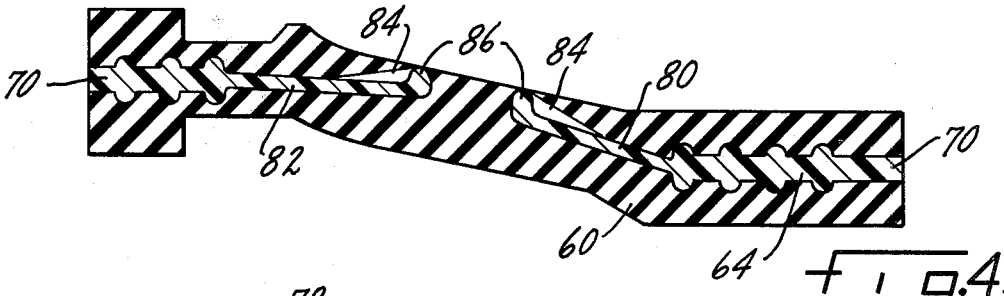
FIG. 4 is a section taken substantially along line 4—4 of FIG. 2.
Figure 5:
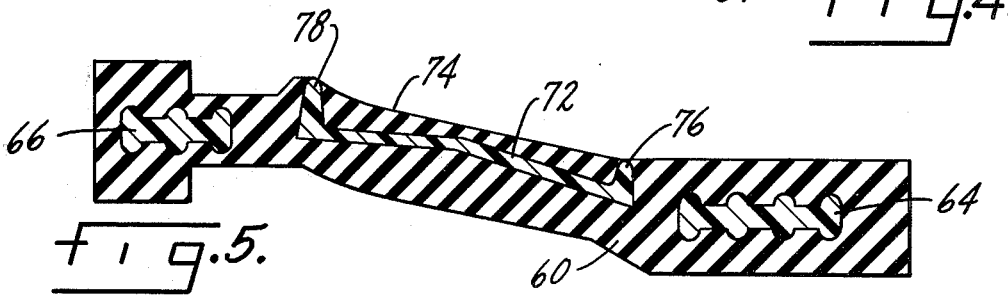
FIG. 5 is a section taken substantially along line 5—5 of FIG. 2.

It can be seen that the configuration of the ribs and fingers is such that at no point is there a direct, straight connection between the inner and outer reinforcing rings. As best seen in FIGS. 3 and 5 there are gaps between the rigid sections 72 and the reinforcing rings. And where the fingers connect to the reinforcing rings there is a central gap between the crimped portions of the rib, as shown in FIG. 4. This configuration permits the flexibility in two directions which is required for proper diaphragm operation.

The ribs 76 and 78 may protrude slightly through the rubber covering 60. The rib 76 acts as a bearing point against the clamping member 54. The rib 78 bears against the inner cover 20 as a fulcrum point for the diaphragm motion. The well-defined fulcrum provided by the rib 78 helps prolong the service life of the diaphragm.

Another advantage of the plastic insert of the present invention is that the by-pass 42 may be formed directly in one of the rigid sections 72 during manufacture of the insert. This is illustrated in FIG. 3. A small core is placed in the by-pass during rubber molding to keep it from being filled with rubber. The filter 44 may then be pressed into an opening in the rubber portion of the diaphragm. Preferably the filter screen will be internal as shown at 88 although an alternate configuration could be to have a bulb-shaped screen shown by the dotted line 90.

It will be realized that whereas a practical and operative structure has been shown, there may be alterations, modifications, and changes made thereto. For example, it is not necessary that the fingers attach the rigid sections to both reinforcing rings. It is possible to connect the rigid sections 72 to one ring or the other. Or in some instances it may be desirable to delete the fingers so that the rigid sections 72 and ribs 76 and 78 are entirely separate from the reinforcing rings. Thus, the invention contemplates a one, two or three-piece configuration for the insert. Also, the ribs 76 and 78 could have a shape other than that shown. Therefore, the invention should not be limited to the specific forms shown, rather, the scope of the invention is defined by the following claims.

We claim:

1. In a flush valve of the type having a hollow body, an inlet, an outlet, a valve seat formed in the body between the inlet and outlet, a flexible diaphragm and means for moving the diaphragm in and out of engagement with the valve seat to control the flow of water through the body, the diaphragm being attached to the body and said means for moving, the improvement comprising a diaphragm including inner and outer peripheral reinforcing means at its points of attachment, a plurality of spaced, rigid sections positioned intermediate said inner and outer reinforcing means, and connecting means integral with said rigid sections for connecting said rigid sections together comprising at least one continuous rib attached to said rigid sections at spaced locations thereon, said connecting means permitting flexibility both in the plane of the diaphragm and perpendicular to the diaphragm.

2. The structure of claim 1 wherein the diaphragm further includes a plurality of fingers attaching the connecting means to the reinforcing means.

3. The structure of claims 1 or 2 wherein the diaphragm further includes a by-pass extending through it, the opening of said by-pass being protected by filter means for preventing entry of sedimentary deposits into the by-pass.

4. The structure of claim 2 wherein the connecting means comprises a pair of continuous ribs, one attached to either side of the rigid sections, each rib having a plurality of fingers attaching the rib to the reinforcing means.

5. The structure of claim 4 wherein the ribs are crimped between successive rigid sections to increase the rib flexibility.

6. The structure of claim 5 wherein the fingers are attached to the ribs at the crimped points.

7. In a flush valve, a hollow body having an inlet, an outlet and a central throat interposed therebetween with a main valve seat formed on the top of the throat, a diaphragm normally closing the valve seat and extending across the body to define an upper chamber, a by-pass in said diaphragm to equalize pressure between the inlet and the upper chamber, an opening in the diaphragm allowing fluid communication between the upper chamber and the outlet, a relief valve attached to the diaphragm and normally-closing said opening, said relief valve being actuatable to initiate a flush by relieving the pressure in the upper chamber which permits the inlet water pressure to flex the diaphragm upwardly, thereby opening the valve seat until the buildup of pressure in the upper chamber re-seats the diaphragm, the improvement comprising a diaphragm including inner and outer peripheral reinforcing means at its point of attachment, a plurality of spaced, rigid sections positioned intermediate said inner and outer reinforcing means and connecting means integral with said rigid sections for connecting said rigid sections together comprising at least one continuous rib attached to said rigid sections at spaced locations thereon, said connecting means permitting flexibility both in the plane of the diaphragm and perpendicular to the diaphragm.

8. The structure of claim 7 wherein the diaphragm further includes reinforcing means and a plurality of fingers attaching the connecting means to the reinforcing means.

9. The structure of claim 7 or 8 wherein the diaphragm further includes filter means at the opening of said by-pass, said filter means preventing entry of sedimentary deposits into the by-pass.

10. The structure of claim 8 wherein the connecting means comprises a pair of continuous ribs, one attached to either side of the rigid sections, each rib having a plurality of fingers attaching the rib to the reinforcing means.

11. The structure of claim 10 wherein the ribs are crimped between successive rigid sections to increase the rib flexibility.

12. The structure of claim 11 wherein the fingers are attached to the ribs at the crimped points.

13. The structure of claim 8 wherein the connecting means comprises a pair of continuous ribs, one attached to either side of the rigid sections, one of said ribs protruding from the diaphragm and bearing against the valve body to act as a fulcrum for the diaphragm motion.

14. The structure of claim 8 wherein the connecting means comprises a pair of continuous ribs, one attached to either side of the rigid sections, one of said ribs protruding from the diaphragm and bearing against the relief valve.

15. In a flexible diaphragm of the type used in flush valves, the improvement comprising said diaphragm including reinforcing means at its points of attachment, said reinforcing means including an inner reinforcing ring and an outer reinforcing ring, a plurality of spaced, rigid sections positioned intermediate said inner and outer reinforcing rings, and connecting means integral with said rigid sections for connecting said rigid sections together comprising at least one continuous rib attached to said rigid sections at spaced locations thereon, said connecting means permitting flexibility both in the plane of the diaphragm and perpendicular to the diaphragm.

16. The structure of claim 15 further comprising a plurality of fingers attaching the connecting means to at least one of the reinforcing rings.

17. The structure of claim 15 or 16 wherein the diaphragm further includes a by-pass extending through it, the opening of said by-pass being protected by filter means for preventing entry of sedimentary deposits into the by-pass.

18. The structure of claim 16 wherein the connecting means comprises a pair of continuous ribs, one attached to either side of the rigid sections, each rib having a plurality of fingers attaching the rib to the reinforcing means.

19. The structure of claim 18 wherein the ribs are crimped between successive rigid sections to increase the rib flexibility.

20. The structure of claim 19 wherein the fingers are attached to the ribs at the crimped points.

* * * * *